US005845949A

United States Patent [19]

Vosbikian

[11] Patent Number: 5,845,949

[45] Date of Patent: Dec. 8, 1998

[54] REINFORCED DELTA SCRAPER SNOW SHOVEL

[76] Inventor: Peter Vosbikian, 408 Pond View Dr., Moorestown, N.J. 08051

[21] Appl. No.: 782,910

[22] Filed: Jan. 11, 1997

[51] Int. Cl.[6] ..... E01H 5/02

[52] U.S. Cl. ..... 294/54.5; 294/56

[58] Field of Search ..... 294/49, 54.5, 55, 294/56, 59; 15/257.9, 236.01; 37/265, 285

[56] References Cited

U.S. PATENT DOCUMENTS

| | | | |
|---|---|---|---|
| D. 257,210 | 10/1980 | Bonnes . | |
| D. 267,468 | 1/1983 | Simms | 294/54.5 |
| D. 298,906 | 12/1988 | Bonnes . | |
| D. 328,553 | 8/1992 | Norton et al. . | |
| D. 329,176 | 9/1992 | Norton et al. . | |
| D. 360,564 | 7/1995 | Tisbo et al. . | |
| D. 361,482 | 8/1995 | Fugal . | |
| D. 363,653 | 10/1995 | Tisbo et al. . | |
| 594,778 | 11/1897 | Charles | 294/55 |
| 860,086 | 7/1907 | Gifford . | |
| 930,660 | 8/1909 | Gifford . | |
| 996,621 | 7/1911 | Danielson . | |
| 1,042,352 | 10/1912 | Kohler | 294/54.5 |
| 1,080,903 | 12/1913 | Fell | 294/49 |
| 1,209,248 | 12/1916 | Beall | 294/49 |
| 1,799,204 | 4/1931 | Wily | 294/54.5 |
| 3,177,026 | 4/1965 | Cowan . | |
| 4,149,744 | 4/1979 | Bonnes . | |
| 4,193,626 | 3/1980 | Vondracek | 37/265 |
| 4,247,141 | 1/1981 | Grint . | |
| 4,248,466 | 2/1981 | Carper . | |
| 4,280,727 | 7/1981 | Germain . | |
| 4,655,494 | 4/1987 | Eads et al. | 294/49 |
| 4,865,373 | 9/1989 | Hudson . | |
| 4,991,324 | 2/1991 | Fine et al. . | |
| 5,228,734 | 7/1993 | Pollastro . | |
| 5,419,600 | 5/1995 | Tisbo et al. . | |

*Primary Examiner*—Dean Kramer
*Attorney, Agent, or Firm*—Stuart M. Goldstein

[57] ABSTRACT

A snow shovel comprises a longitudinally elongated handle and a curved generally rectangular blade receiving an end of the handle on the convex surface of the blade. The blade is curved respecting a transverse axis and includes a scraper support edge extending transversely to the handle, defining a blade extremity remote from the handle. The blade further includes an upstanding lip on its periphery not defined by the scraping edge, extending transversely to the blade in the direction of the blade concave surface, with the portion of the lip being parallel to the handle, preferably being canted inwardly towards the handle. The blade further has upstanding triangularly configured reinforcing gussets formed in the blade and protruding from the blade concave surface, generally parallel with the handle, with the gussets having heights and widths at least initially increasing with distance from the scraping edge. The shovel also includes a generally triangular scraper connected to and fitting flushly against the blade. The scraper has an edge adapted for complemental fitting around and extending parallel to the handle. The scraper edge defines a long side of the triangular shape. Two remaining shorter sides of the scraper converge to a vertex.

19 Claims, 3 Drawing Sheets

REINFORCED DELTA SCRAPER SNOW SHOVEL

BACKGROUND OF THE INVENTION

1. Field of the Invention

This invention relates to hand tools and shovels in general and in particular to snow shovels.

2. Description of the Prior Art

Snow shovels are known and widely used for shoveling snow in the winter season in the northern latitudes. While conventional snow shovels have achieved a wide degree of acceptance, a common problem associated with conventional snow shovels is excessive wear and even failure when the user of the snow shovel encounters ice or endeavors to use the snow shovel for chipping or otherwise removing ice. Unfortunately, ice often accompanies snow and is many times found underneath the snow to be shoveled. It is necessary to remove the ice on walkways and driveways in order to assure safe passage therealong.

Conventional snow shovels typically manufactured with metal blades are excessively heavy and not preferred by consumers. While metal blades provide reasonable ice chipping capability, the heavy weight of the shovel resulting from the use of metal in the blade makes the shovel less than desirable.

Plastic blade snow shovels are known and have the advantage of being lightweight. However, plastic blade snow shovels are prone to wear rapidly and many times fail when ice is encountered. Moreover, plastic snow shovels cannot be used effectively for chipping ice due to the resilient character of the plastic snow shovel blade.

U.S. Pat. Nos. 5,419,600; D360,564 and D363,653 disclose snow shovels of various types.

SUMMARY OF THE INVENTION

In one of its aspects this invention provides a snow shovel including a longitudinally elongated handle and a curved generally rectangular blade receiving an end of the handle on the convex surface of the blade. The blade is curved respecting a transverse axis and includes a scraper support edge extending transversely respecting the handle, defining a blade extremity remote from the handle.

The blade further preferably includes an upstanding lip on the periphery of the blade not defined by the scraping edge, extending transversely respecting the blade in the direction of the blade concave surface, with the portion of the lip paralleling the handle preferably being canted inwardly towards the handle. The blade further has upstanding triangularly configured reinforcing gussets formed in the blade and protruding from the blade concave surface, generally parallel with the handle, with the gussets having height and width at least initially increasing with distance from the scraping edge.

The shovel further preferably includes a generally triangular scraper connected to the blade and fitting flushly against the blade including a scraper edge adapted for complemental fitting around and extending in parallel with the handle from the scraper support edge. The scraper support edge defines a long side of the triangular shape. Two remaining shorter sides of the scraper converge to a vertex.

Preferably at least one of the gussets is collinear with the handle. Further preferably the gussets diverge from the handle upon approaching the scraping edge.

Figure 1:
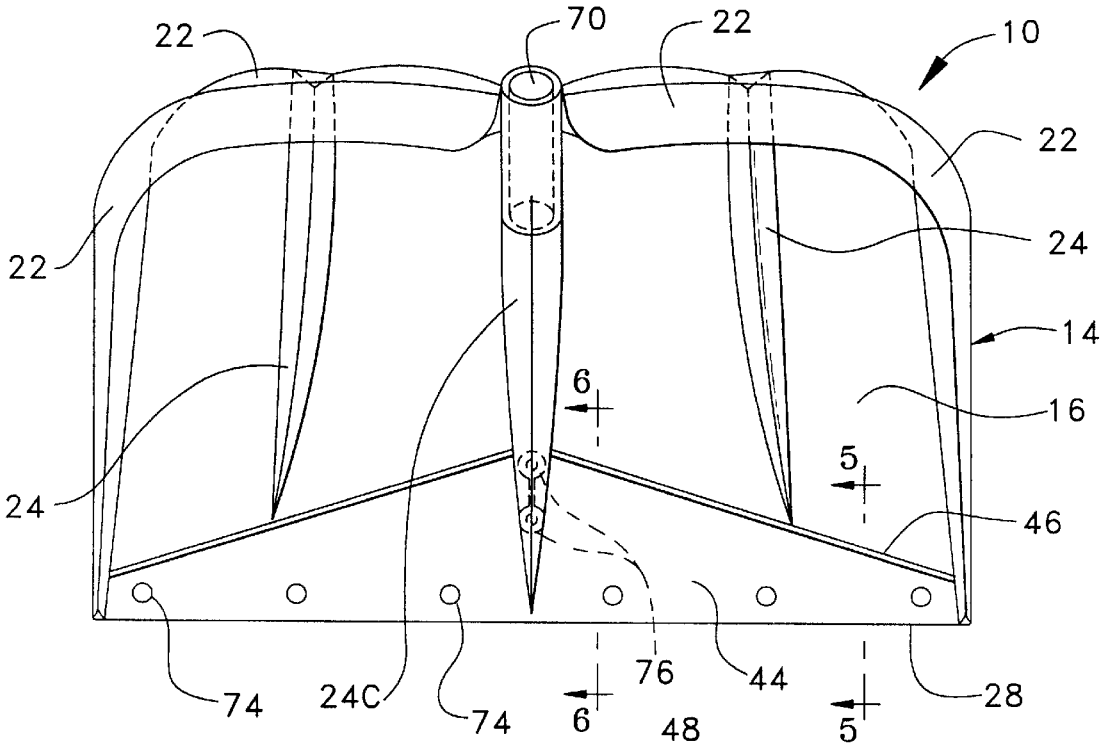
FIG. 1 is a view of the front of the blade portion of a snow shovel manifesting aspects of the invention.

DESCRIPTION OF THE PREFERRED EMBODIMENTS AND BEST MODE KNOWN FOR PRACTICING THE INVENTION

Referring to the drawings in general and to FIGS. 1 through 4 in particular, a snow shovel embodying aspects of the invention is designated generally 10 and includes an elongated handle 12 connected to a blade designated generally 14. Handle 12 is received by a receptacle which is generally cylindrical in shape and is positioned on the convex side of blade 14 of shovel 10. The receptacle is designated generally 70 in the drawings. Receptacle 70 is of integral construction with blade 14 and is connected thereto via reinforcing webs 72 for increased structural rigidity and strength of shovel 10.

A concave side of blade 14 is designated generally 16 while a convex side of blade 14 is designated generally 18.

Shovel 10 further includes a generally triangular scraper which has been designated generally 20 in the drawings. Scraper 20 includes a scraping edge 26 which runs transversely to handle 12.

Blade 14 further includes a scraper support edge 28 which runs generally parallel with scraping edge 26 and provides support for scraping edge 26 of scraper 20. Blade 14 further includes a peripheral lip designated 22 in the drawings extending generally around the three sides of the periphery of blade 14 which are in addition to scraper support edge 28, which defines the fourth side of generally rectangular curved blade 14.

Figure 2:
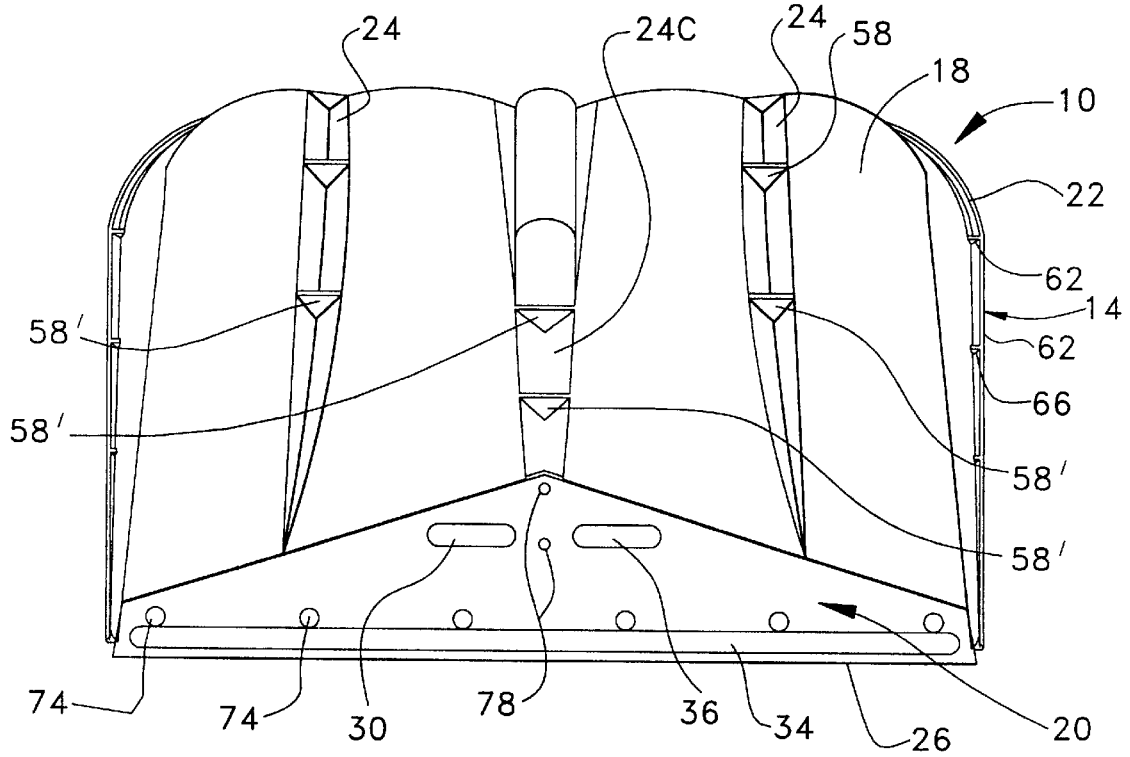
FIG. 2 is view of the rear of the blade and scraper portions of a snow shovel manifesting aspects of the invention as illustrated in FIG. 1.
Figure 4:
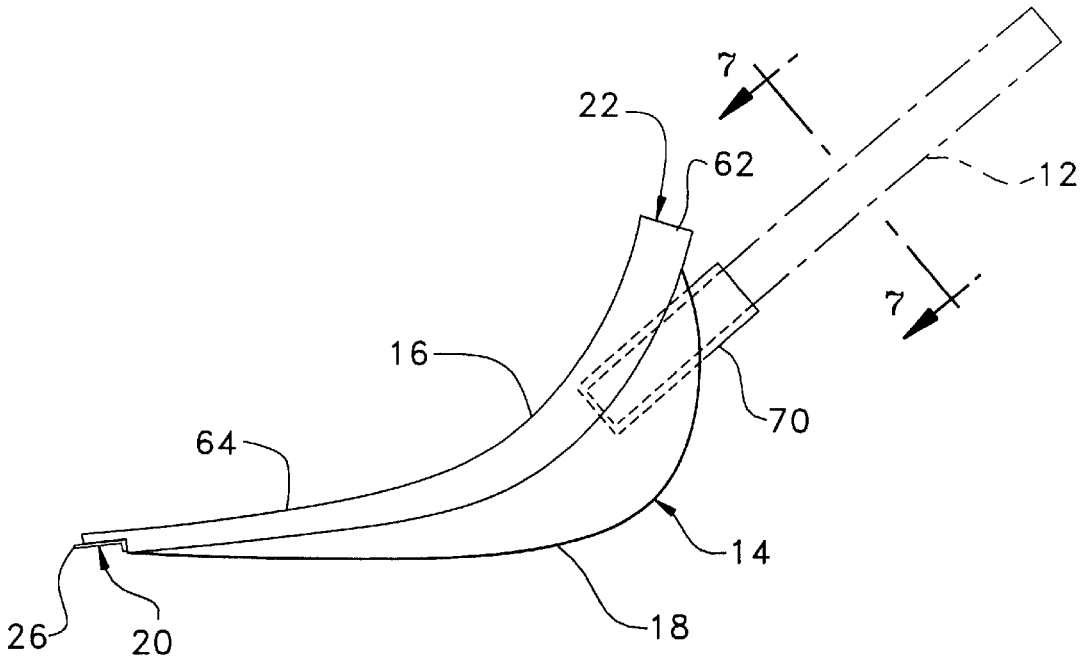
FIG. 4 is a side view of a snow shovel manifesting aspects of the invention as illustrated in FIGS. 1 through 3 with the shovel positioned with the forward, scraping edge of the shovel essentially tangent to grade.

Lip 22 extends transversely respecting concave side 16 of blade 14 in a forward direction as illustrated in FIG. 4. Lip 22 is of unitary construction with the remainder of blade 14, with an outwardly facing surface of 62 of lip 22 connecting with the remainder of blade 14 at the forward periphery 64 thereof. Ribs 66 extend transversely between outer surface 62 of lip 22 and the remainder of blade 14; ribs 66 are illustrated in FIG. 2 but have not been shown in the other drawings for purposes of drawing clarity. Hence, the forward periphery 64 of lip 22 makes it appear that lip 22 is effectively folded over from the remainder of blade 14.

Figure 3:
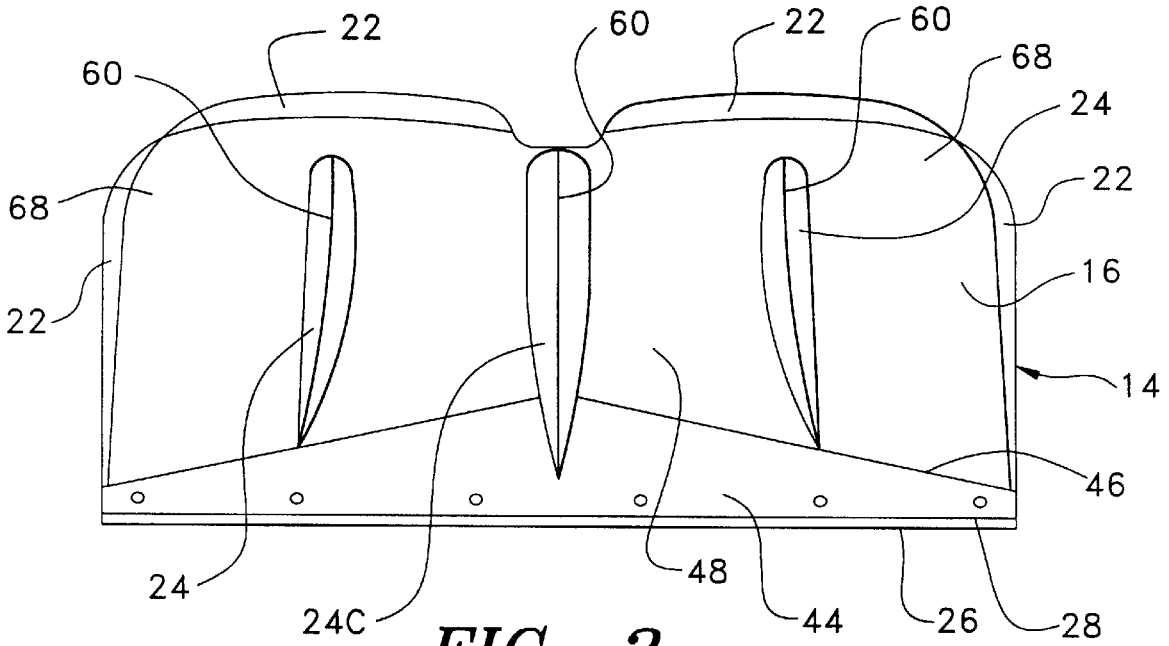
FIG. 3 is a front view of a snow shovel manifesting aspects of the invention as illustrated in FIGS. 1 and 2 with the blade tilted into a position ready to shovel snow, with the forward or scraping edge of the snow shovel blade essentially tangent with grade.

As illustrated in FIGS. 1 and 3 and particularly in FIG. 3, lip 22 increases in transverse length relative to concave surface 16 with movement away from scraping edges 26 and 28, preferably rising to a height of about 1 or 1 and ½ inches at the position before lip 22 curves to fit about upper curved corners 68 of blade 14 as illustrated in FIGS. 1 and 3. Construction of lip 22 with reinforcing ribs 66 and presence of lip 22 around the curved periphery of generally rectangular blade 16 provides additional structural rigidity for blade 16.

A plurality of triangular reinforcing gussets 24 are formed in blade 14 to provide additional strength to blade 14. Gussets 24 are triangular in shape and are formed as raised structures in concave surface 16 of blade 14. Gussets 24 provide reinforcement and stiffening for blade 14; this is important because blade 14 is preferably injection molded plastic. Gussets 24 are integrally formed in blade 14.

As illustrated in FIGS. 1 and 2, gusset height and width increases with longitudinal distance along at least a part of each gusset. Specifically, as the gussets extend away from the forward portion of shovel 10 defined by edges 26 and 28, the gussets increase in height and width. The height of the gusset is indicated by the what appears to be the depth of the gusset in FIG. 2, illustrating the lower portion or back side of shovel 10 where the gussets appear as depressions in concave or rear or bottom surface of shovel 10.

Gussets 24 are longitudinally elongated and a central gusset, designated 24C in the drawings, is longitudinally aligned with handle 12 of shovel 10.

Gussets 24 are symmetrically disposed with respect to handle 12. The raised character of gussets 24, together with ribs 58 which are of triangular shape and run transversely to gussets 24 as illustrated in FIG. 2, provides very excellent rigidity for the blade of shovel 10. Ribs 58 are integrally formed within gussets 24. Preferably ribs 58 are transversely aligned as indicated by ribs 58' in FIG. 2. Transverse alignment of ribs 58 further contributes to the rigidity of blade 14.

Central gusset 24C is larger than the remaining ones of gussets 24, being both wider than the remainder of the gussets and longer than the gussets and most closely approaches the blade longitudinal extremity remote from the handle, all as illustrated in FIGS. 1, 2 and 3.

Vertices of the gussets extend longitudinally and are designated generally 60 in the drawings. Vertices 60 are preferably concave in the same direction as concave surface 16 of blade 14 of shovel 10.

Longitudinal extremities of the respective gussets are inboard from the periphery of blade 14 as best illustrated in FIG. 3. The gussets preferably emerge from concave surface 16 of blade 14 at respective ends of the gussets so that the gussets smoothly emerge from and merge into concave surface 16 thereby providing maximum receptiveness of concave surface 16 to snow when the shovel is pushed into the snow.

Scraper 20 is of generally isosceles triangular configuration as is clearly illustrated in FIG. 2 of the drawings. Scraper 20 lies on the underside of blade 14; the underside of blade 14 is the convex side 18 of blade 14.

Blade 14 is fabricated with a step portion to receive scraper 20. Specifically, a portion of blade 14 is generally triangular in shape and provides a scraper backing support; this portion of blade 14 is designated generally 44 in the drawings and is illustrated in FIG. 1. Portion 44 is also shown in FIGS. 5 and 6.

A remaining portion of blade 14 is designated generally 48 and does not provide backing support for triangular scraper 20. This portion of blade 14 is illustrated in FIGS. 1, 5 and 6.

Figure 5:
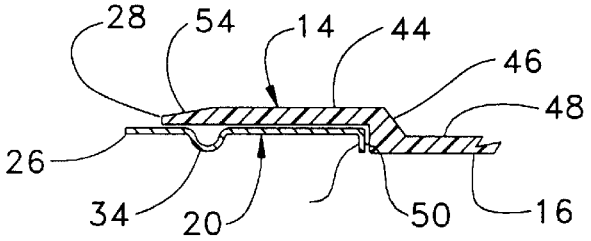
FIG. 5 is a broken partial sectional view taken at lines and arrows 5—5 in FIG. 1.
Figure 6:
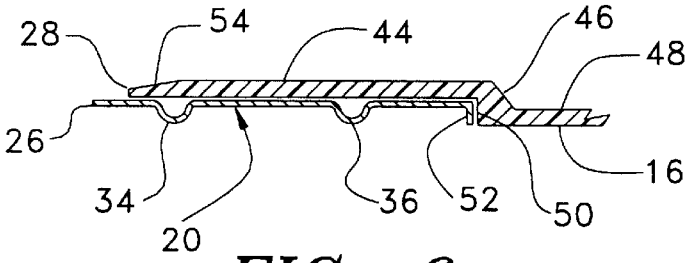
FIG. 6 is a broken partial sectional view taken at lines and arrows 6—6 in FIG. 1.
Figure 7:
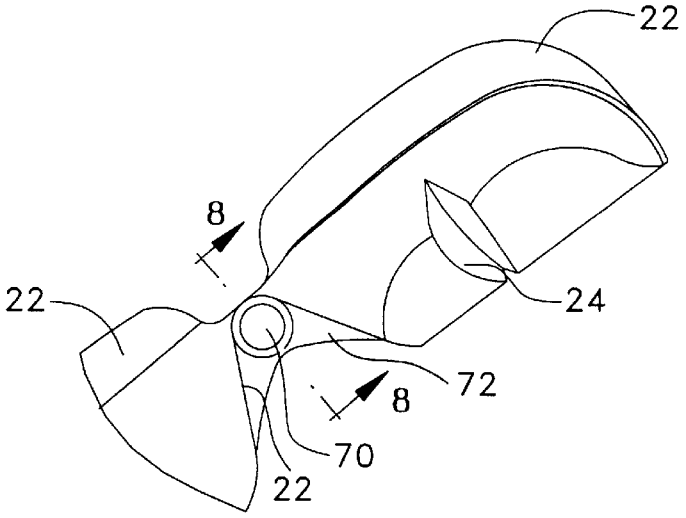
FIG. 7 is broken rear projection taken as indicated by lines and arrows 7—7 in FIG. 4.
Figure 8:
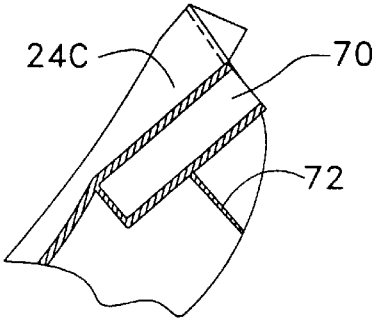
FIG. 8 is a broken schematic sectional view taken at lines and arrows 8—8 in FIG. 7.

Transition between triangular scraper backing support portion 44 and portion 48 of blade 14 which does not support triangular scraper 20 is provided by an angular stepdown 46 shown in FIGS. 5 and 6 and also visible in FIG. 1.

As illustrated in FIGS. 5 and 6, blade 14 is of essentially the same thickness throughout with the preferred thickness being about ⅛ of an inch. Blade 14 is preferably a single injection molded piece of plastic.

Formed at the juncture of blade portions 44 and 48 is a generally transverse shoulder 50 in convex side 18 of blade 14. Shoulder 50 is illustrated in FIGS. 5 and 6 and is preferably in the neighborhood of ⅛ to 3⁄16 inches in length where the length of shoulder 50 is measured in the direction perpendicular to concave surface 16 of blade 14.

Scraper 20 is formed with a transverse load transfer edge 52 at the edge of scraper 20 remote from scraping edge 26. Load transfer edge 52 is illustrated in FIGS. 2, 5 and 6 and consists of a portion of triangular scraper 20 which has been bent transversely relative to the remainder of scraper 20, in a downward direction illustrated in FIGS. 5 and 6, to provide an edge extending angularly with respect to concave side 16 of blade 14, for abutting contact with transverse shoulder 50 of blade 14. This is illustrated in FIGS. 5 and 6.

Triangular scraper backing support portion 44 of blade 14 in the vicinity of scraper support edge 28 tapers slightly. This taper is provided by a section of reduced thickness having an angularly disposed outer surface 54 illustrated in FIGS. 5 and 6.

Taper provided by surface 54 results in scraper support edge 28 being relatively thin, facilitating snow sliding onto the snow support surface defined by concave side 16 of blade 14 when shovel 10 is used.

Scraper support edge 28 is slightly longitudinally removed from scraping edge 26 of scraper 20, as illustrated in FIGS. 5 and 6. Since scraper 26 is preferably metal, this construction results in a metal edge protruding from the shovel and being presented to the snow.

Scraping edge 26 is exceedingly useful in scraping ice and in chipping ice without significant wear to shovel 10. Preferably plastic blade 14 and particularly scraper support edge 28 and tapered surface 54 are protected from excessive wear due to contact with ice by their recessed location respecting scraping edge 26.

Scraper 20 further includes a wear bar 34 preferably formed in scraper 20 by stamping scraper 20 in a suitable fixture. Wear bar 34 preferably extends essentially the transverse width of scraper 20 and supports the remainder of scraper 20 and shovel 10 slightly above grade when shovel 10 is in the snow shoveling position as depicted generally in FIG. 4. Wear bar 34 has not been illustrated in FIG. 4 for purposes of drawing clarity. Wear bar 34 is shown in FIGS. 2, 5 and 6.

Scraper 20 further preferably includes a pair of wear pads 36 which are also shown in FIG. 2 and are longitudinally removed from and oriented along the line parallel with wear bar 34. Wear pads 36 are similarly preferably formed in scraper 20 by a pressing operation and serve to further support shovel 10 above grade when the shovel is in the operating position where the shovel may scrapingly contact a driveway, a concrete or asphalt walk or some other abrasive surface from which snow is to be removed.

The triangular construction of scraper 20 together with the angular orientation of shoulder 50 of blade 14, with shoulder 50 being disposed at an angle relative to the longitudinal axis, results in efficient and effective transfer of forces applied to scraper 20 during chipping or scraping with force being transferred from scraper 20 to blade 14 in a direction generally towards handle receptacle 70. The angular orientation of generally transverse shoulder 50 of blade 14 and transverse load transfer edge 52 of scraper 20 serves to resolve forces resulting on scraper 20 from chipping ice towards central gusset 24C and hence to handle 12 via receptacle 70. This results in shovel 10 being effective for use as an ice chipper in light of the provision of metal chipping edge 26 but avoids the disadvantages of heavy all metal shovels and the disadvantages of plastic shovels by providing a high strength, reinforced plastic backing blade for the metal chipping and scraping member. The triangular shape of scraper 20 effectively transfers force between the handle and the scraping edge thereby avoiding damage and destruction to the plastic blade 14.

Triangular scraper 20 is preferably rigidly connected to blade 14 by a series of rivets 74 which are preferably aligned with and closely longitudinally spaced from wear bar 34. The heads of rivet 74 are preferably flush with scraper 20 and remaining extremities of rivet 74 are preferably flush with blade 14. With this structure the raised character of wear bar 34 protects rivet 74 from wear during use of the shovel. The raised character of wear bar 34 relative to the remaining flat surface of scraper 20 is evident from FIGS. 5 and 6.

Securement of scraper 20 to blade 14 is further effectuated by the presence of two screw bosses 76 which are molded in place within the interior of gusset 24C and are illustrated in dotted lines in FIG. 1. Screw bosses 76 receive suitable screws depicted schematically as 78 in FIG. 2 which further secure scraper 20 to blade 16. Preferably screws 78 are provided with countersunk holes so that the screw heads are flush with the outer surface of scraper 20.

What is claimed is:

1. A snow shovel comprising:

a. longitudinally elongated handle;

b. a transversely curved blade comprising:

i. a receptacle on a convex side of said blade receiving said handle;

ii. a scraper support edge extending transversely respecting said handle and defining a blade longitudinal extremity remote from said handle;

c. an isosceles triangularly-shaped scraper connected to said blade, comprising:

i. a scraping edge defined by the long side of said triangular shape extending transversely to said handle;

ii. a shoulder extending in two directions transversely to and facing said handle, longitudinally abutting an oppositely facing surface formed in said blade;

iii. a central portion extending longitudinally from said shoulder and being in substantially facing contact with said blade;

iv. a longitudinal extremity of said scraper remote from said shoulder being transverse to said handle and extending the width of said blade, extending longitudinally beyond the longitudinal extremity of said blade to define said scraping edge of said scraper;

v. a bulbous protrusion formed in said central portion and extending transversely substantially the width of said scraper proximate said scraper support edge of said blade; and vi. a pair of bulbous wear pads formed in said central portion, located at a common longitudinal location on said scraper, protruding from said scraper central portion in the same direction as said bulbous protrusion wear pads being symmetrically disposed respecting said handle.

2. A snow shovel comprising:

a. a longitudinally elongated handle;

b. a rectangular transversely curved blade, comprising:

i. a transversely extending edge defining a blade scraping extremity remote from said handle;

ii. a receptacle receiving said handle and located proximate the midpoint of the blade;

iii. a pair of upstanding lips extending along respective peripheries of said blade not defined by said transversely extending edge, said lips extending transversely from said blade in the upwardly facing direction of a snow carrying concave surface of said blade, for restraining snow from falling off of the edges of said snow carrying concave surface; and c. a triangularly shaped scraper connected to said blade, comprising:

i. a scraping edge defined by the long side of said triangular shape extending transversely to said handle;

ii. a shoulder extending in two directions transversely to and facing said handle longitudinally abutting an oppositely facing surface formed in said blade;

iii. a central portion extending longitudinally from said shoulder and being in substantially facing contact with said blade; and iv. a longitudinal extremity of said scraper remote from said shoulder being transverse to said handle and extending the width of said blade, extending longitudinally beyond the longitudinal extremity of said blade to define said scraping edge of said scraper.

3. The snow shovel of claim 2 in which a bulbous protrusion is formed in said central portion, extending transversely substantially the width of said scraper proximate said scraper support edge of said blade, and in which a pair of bulbous wear pads is formed in said central portion, located at a common longitudinal location on said scraper, protruding from said scraper central portion in the same direction as said bulbous protrusion, said wear pads being symmetrically disposed respecting said handle.

4. A snow shovel comprising:

a. a longitudinally elongated handle;

b. a transversely curved blade connected to said handle, comprising a scraper support edge extending transversely respecting said handle and defining a blade extremity remote from said handle; and c. a triangularly shaped scraper connected to said blade, comprising:

i. a scraping edge defined by the long side of said triangular shape extending transversely to said handle;

ii. a shoulder extending in two directions transversely to and facing said handle, longitudinally abutting anoppositely facing surface formed in said blade;

iii. a central portion extending longitudinally from said shoulder and being in substantially facing contact with said blade;

iv. a longitudinal extremity of said scraper remote from said shoulder being transverse to said handle and extending the width of said blade, extending longitudinally beyond the longitudinal extremity of said blade to define said scraping edge of said scraper.

5. The snow shovel of claim 4 further comprising a plurality of upstanding triangularly configured reinforcing gussets formed in said blade and protruding from the blade concave surface and wherein gusset height and width increases with longitudinal distance along at least a part of said gusset.

6. The snow shovel of claim 5 wherein said gussets are longitudinally elongated.

7. The snow shovel of claim 5 wherein one of said gussets is longitudinally aligned with said handle.

8. The snow shovel of claim 7 wherein said gusset aligned with said longitudinally elongated handle is larger than the remaining gussets.

9. The snow shovel of claim 7 wherein said gusset aligned with said handle is wider than the remainder of said gussets.

10. The snow shovel of claim 7 wherein said gusset aligned with said handle is longer than the remainder of said gussets.

11. The snow shovel of claim 7 wherein said gusset aligned with said handle most closely approaches said blade longitudinal extremity remote from said handle.

12. The snow shovel of claim 5 wherein said gussets are symmetrically disposed with respect to said handle.

13. The snow shovel of claim 5 wherein sides of said gussets are concave.

14. The snow shovel of claim 5 further comprising a plurality of ribs integrally formed within said gussets and extending transversely thereto.

15. The snow shovel of claim 14 wherein said ribs are transversely aligned.

16. The snow shovel of claim 5 wherein said gussets comprises concave vertices.

17. The snow shovel of claim 5 wherein at least some of said gussets emerge from said concave surface of said blade at respective ends of said gussets.

18. The snow shovel of claim 5 wherein said gusset longitudinal extremities are inboard of the periphery of said blade.

19. A snow shovel comprising:

a. a longitudinally elongated handle;

b. an integrally formed rectangular transversely curved blade with a scraper support edge extending transversely respecting said handle, said blade comprising:

i. a receptacle receiving said handle located on a convex side of said blade proximate the midpoint of the blade;

ii. a pair of upstanding lips extending along respective peripheries of said blade not defined by said scraping support edge, said lips extending transversely from said blade in the upwardly facing direction of a snow carrying concave surface of said blade, for restraining snow from falling off of the edges of said snow carrying concave surface;

iii. a plurality of upstanding triangularly configured reinforcing gussets formed in said blade and protruding from the blade concave surface;

(1) gusset height and width increasing with longitudinal distance along at least a part of said gusset;

(2) said gussets being longitudinally elongated;

(3) one of said gussets being longitudinally aligned with said handle;

(4) said gussets being symmetrically positioned with respect to said handle;

(5) sides of said gussets being concave;

(6) said gusset aligned with said longitudinally elongated handle being larger, wider and longer than the remainder of said gussets and most closely approaching said blade longitudinal extremity remote from said handle;

(7) vertices of said gussets being concave;

(8) at least some of said gussets emerging from said concave surface of said blade at respective ends of said gussets;

(9) said gusset longitudinal extremities being inboard of the periphery of said blade;

iv. a plurality of ribs integrally formed within said gussets and extending transversely thereto, said ribs being transversely aligned; and c. an isosceles triangularly-shaped scraper connected to said blade, comprising:

i. a scraping edge defined by the long side of said triangular shape extending transversely to said handle;

ii. a shoulder extending in two directions transversely to and facing said handle, longitudinally abutting an oppositely facing surface formed in said blade;

iii. a central portion extending longitudinally from said shoulder and being in substantially facing contact with a scraper support portion of said blade;

iv. a longitudinal extremity of said scraper remote from said shoulder being transverse to said handle and extending the width of said blade, extending longitudinally beyond the longitudinal extremity of said blade to define said scraping edge of said scraper;

v. a bulbous protrusion formed in said central portion and extending transversely substantially the width of said scraper proximate said scraper support edge of said blade;

vi. a pair of bulbous wear pads formed in said central portion, located at a common longitudinal location on said scraper, protruding from said scraper central portion in the same direction as said bulbous protrusion, said wear pads being symmetrically disposed respecting said handle.

* * * * *